US012590743B2

(12) United States Patent
Wakasugi et al.

(10) Patent No.: US 12,590,743 B2
(45) Date of Patent: Mar. 31, 2026

(54) REFRIGERATION CYCLE APPARATUS AND LEAKAGE INSPECTION METHOD FOR REFRIGERANT PIPING OF REFRIGERATION CYCLE APPARATUS

(71) Applicant: CARRIER JAPAN CORPORATION, Tokyo (JP)

(72) Inventors: Junichi Wakasugi, Shizuoka (JP); Kazushi Takeuchi, Shizuoka (JP); Kaoru Matsushita, Shizuoka (JP)

(73) Assignee: CARRIER JAPAN CORPORATION, Tokyo (JP)

( * ) Notice: Subject to any disclaimer, the term of this patent is extended or adjusted under 35 U.S.C. 154(b) by 95 days.

(21) Appl. No.: 18/579,011

(22) PCT Filed: Jul. 14, 2021

(86) PCT No.: PCT/JP2021/026389
§ 371 (c)(1),
(2) Date: Jan. 12, 2024

(87) PCT Pub. No.: WO2023/286183
PCT Pub. Date: Jan. 19, 2023

(65) Prior Publication Data
US 2024/0310098 A1 Sep. 19, 2024

(51) Int. Cl.
*F25B 49/02* (2006.01)
*F25B 41/40* (2021.01)

(52) U.S. Cl.
CPC ..... *F25B 49/02* (2013.01); *F25B 41/40* (2021.01); *F25B 2500/222* (2013.01)

(58) Field of Classification Search
CPC .... F25B 49/02; F25B 41/40; F25B 2500/222; F25B 2313/003; F25B 49/005; F25B 13/00
See application file for complete search history.

(56) References Cited

U.S. PATENT DOCUMENTS

2009/0223284 A1 9/2009 Bühring
2016/0238179 A1 8/2016 Yamamoto et al.
(Continued)

FOREIGN PATENT DOCUMENTS

JP 56-035900 A 4/1981
JP H04177071 A 6/1992
(Continued)

OTHER PUBLICATIONS

Office Action for Japanese Patent Application No. 2023534496, mailed Mar. 19, 2023, 8 pages.
(Continued)

*Primary Examiner* — Joseph F Trpisovsky
(74) *Attorney, Agent, or Firm* — DLA PIPER LLP (US)

(57) ABSTRACT

Proposed are a refrigeration cycle apparatus and a leakage inspection method for refrigerant piping of a refrigeration cycle apparatus, in both of which leakage inspection of joints of the refrigerant piping can be readily performed regardless of where the joints of the refrigerant piping are provided, including a space being hard-to approach, inaccessible, and extremely narrow. A refrigeration cycle apparatus includes: a plurality of pipe materials; refrigerant piping including a joint that joins the pipe materials by brazing or welding; and a piping cover that covers at least part of the refrigerant piping including the joint and has a leakage inspection port that allows a gas to flow out from the inside to the outside.

5 Claims, 6 Drawing Sheets

(56) References Cited

U.S. PATENT DOCUMENTS

| | | | | |
|---|---|---|---|---|
| 2016/0238181 | A1 | 8/2016 | Suzuta et al. | |
| 2017/0370605 | A1* | 12/2017 | Makino | F24F 11/36 |
| 2022/0243952 | A1* | 8/2022 | Kojima | F24F 1/0068 |

FOREIGN PATENT DOCUMENTS

| | | | |
|---|---|---|---|
| JP | 2000230761 | A | 8/2000 |
| JP | 2003130504 | A | 5/2003 |
| JP | 2004028778 | A | 1/2004 |
| JP | 2008164331 | A | 7/2008 |
| JP | 2009511884 | A | 3/2009 |
| JP | 2009068772 | A | 4/2009 |
| JP | 2011052863 | A | 3/2011 |
| JP | 2013245725 | A | 12/2013 |
| JP | 2016151501 | A | 8/2016 |
| JP | 2016151502 | A | 8/2016 |
| JP | 2020159817 | A | 10/2020 |
| WO | 2020179481 | A1 | 9/2020 |

OTHER PUBLICATIONS

International Search Report in PCT/JP2021/026389, dated Jul. 14, 2021.

Extended European Search Report for Application No. 21950124.4 dated Mar. 13, 2025, 8 Pages.

Office Action for Japanese Patent Application No. 2023534496, mailed Oct. 8, 2024, 10 pages.

* cited by examiner

REFRIGERATION CYCLE APPARATUS AND LEAKAGE INSPECTION METHOD FOR REFRIGERANT PIPING OF REFRIGERATION CYCLE APPARATUS

CROSS REFERENCE TO RELATED APPLICATIONS

This application is a U.S. National Stage Application of International Application No. PCT/JP2021/026389 filed Jul. 14, 2021. The entirety of the above-listed application is incorporated herein by reference.

TECHNICAL FIELD

Embodiments of the present invention relate to a refrigeration cycle apparatus and a leakage inspection method for refrigerant piping of a refrigeration cycle apparatus.

BACKGROUND

A known detection apparatus detects slight leakage of liquid metal from piping in a fast breeder reactor plant or a plant that uses liquid metal. If a crack or the like occurs in sodium piping and sodium leaks into the space between the sodium piping and the surrounding heat insulation material, this detection apparatus sucks in slight solid particles (aerosol) of sodium produced by the reaction between the leaked sodium and the atmospheric gas as well as cooling through a suction pipe, guides it to a sodium leakage detector, and measures and monitors the sodium aerosol contained in the gas so as to detect leakage of sodium.

PRIOR ART DOCUMENT

Patent Document

[Patent Document 1] JP S56-035900 A

SUMMARY

Problems to be Solved by Invention

There is a heat source apparatus, for example, a refrigeration cycle apparatus such as a chiller. This type of refrigeration cycle apparatus includes a housing to be installed outdoors, an air heat exchanger housed in the upper half of the housing, as well as a water heat exchanger, a compressor, and an expansion valve housed in the lower half of the housing, while in some cases, a four-way valve is also housed in the lower half of the housing. The air heat exchanger, the water heat exchanger, the compressor, the expansion valve, and the four-way valve are connected to refrigerant piping through which a refrigerant flows. The refrigerant piping has a plurality of joints that are joined by welding or brazing. Moreover, the refrigerant piping is covered with a heat insulation material.

The water heat exchanger, the compressor, the expansion valve, the four-way valve, and the refrigerant piping are densely housed at the bottom portion of the housing to minimize the outdoor footprint. Thus, the joints of the refrigerant piping in this type of refrigeration cycle apparatus may be located at positions that are difficult to approach and have low accessibility. Further, in some cases, the surroundings of the joints of the refrigerant piping are extremely narrow. It is extremely difficult to perform leakage inspection of the joints of the refrigerant piping in such a hard-to-approach, inaccessible, and extremely narrow space.

However, as in the convention detection apparatus, when the suction pipe to be connected to the space between the piping and the heat insulation material surrounding the piping is installed inside the housing in addition to the water heat exchanger, the compressor, the expansion valve, the four-way valve, and the refrigerant piping, such a layout hinders miniaturization of the housing and leads to increase in size. Hence, it is difficult for this type of refrigeration cycle apparatus to adopt a structure that requires a suction pipe like the conventional detection apparatus. In addition, the conventional detection apparatus also requires a pump to suck in the sodium aerosol into the suction pipe. This pump also hinders miniaturization of the housing and leads to increase in size.

An object of the present invention is to provide a refrigeration cycle apparatus and a leakage inspection method for refrigerant piping of a refrigeration cycle apparatus, in both of which leakage inspection of joints of the refrigerant piping can be readily performed regardless of where the joints of the refrigerant piping are provided, including a space being hard-to approach, inaccessible, and extremely narrow.

Means for Solving Problem

To solve the above-mentioned problem, a refrigeration cycle apparatus according to one embodiment of the present invention includes a compressor; a condenser; an expansion valve; an evaporator; refrigerant piping that connects the compressor, the condenser, the expansion valve, and the evaporator and circulates a refrigerant; and a piping cover that covers at least part of the refrigerant piping, wherein: the refrigerant piping includes a plurality of pipe materials and a joint that joins the pipe materials by brazing or welding; and the piping cover covers the joint and has a leakage inspection port that allows a gas to flow from inside of the piping cover to outside of the piping cover.

The leakage inspection port of the refrigeration cycle apparatus according to one embodiment of the present invention is preferably disposed below the joint when the gas is higher in specific gravity than air, and is preferably disposed above the joint when the gas is lower in specific gravity than the air.

The refrigeration cycle apparatus according to one embodiment of the present invention preferably further includes a pair of constrictors that sandwich at least one joint and at least one leakage inspection port and narrow a gap between the piping cover and the refrigerant piping.

The refrigeration cycle apparatus according to one embodiment of the present invention may further include a leakage inspection pipe that is covered with the piping cover together with the refrigerant piping and provided with an inlet opening disposed near the joint and an outlet opening connected to the leakage inspection port.

To solve the above-mentioned problem, a leakage inspection method for refrigerant piping of a refrigeration cycle apparatus according to another embodiment of the present invention, wherein the refrigeration cycle apparatus includes: a compressor; a condenser; an expansion valve; an evaporator; a piping cover provided with a leakage inspection port configured to allow a gas to flow from inside of the piping cover to outside of the piping cover; and refrigerant piping that is at least partially covered with the piping cover, connects the compressor, the condenser, the expansion valve, and the evaporator, circulates a refrigerant, and has a joint joined by brazing or welding, the leakage inspection method includes: a filling step of filling the refrigeration cycle apparatus with a leak detection gas excluding air as the gas until pressure becomes higher than atmospheric pressure; a detection step of detecting concentration of oxygen at the leakage inspection port or concentration of the leakage detection gas at the leakage inspection port; and a determination step of determining whether leakage occurs at the joint based on a detection result of the detection step.

Effects of Invention

The present invention can provide a refrigeration cycle apparatus and a leakage inspection method for refrigerant piping of a refrigeration cycle apparatus, in both of which leakage inspection of joints of the refrigerant piping can be readily performed regardless of where the joints of the refrigerant piping are provided, including a space being hard-to approach, inaccessible, and extremely narrow.

DETAILED DESCRIPTION

Embodiments of a refrigeration cycle apparatus and a leakage inspection method for refrigerant piping of a refrigeration cycle apparatus according to the present invention will be described by referring to FIG. 1 to FIG. 8. The same reference signs are given to identical or equivalent components in each figure.

Figure 1:
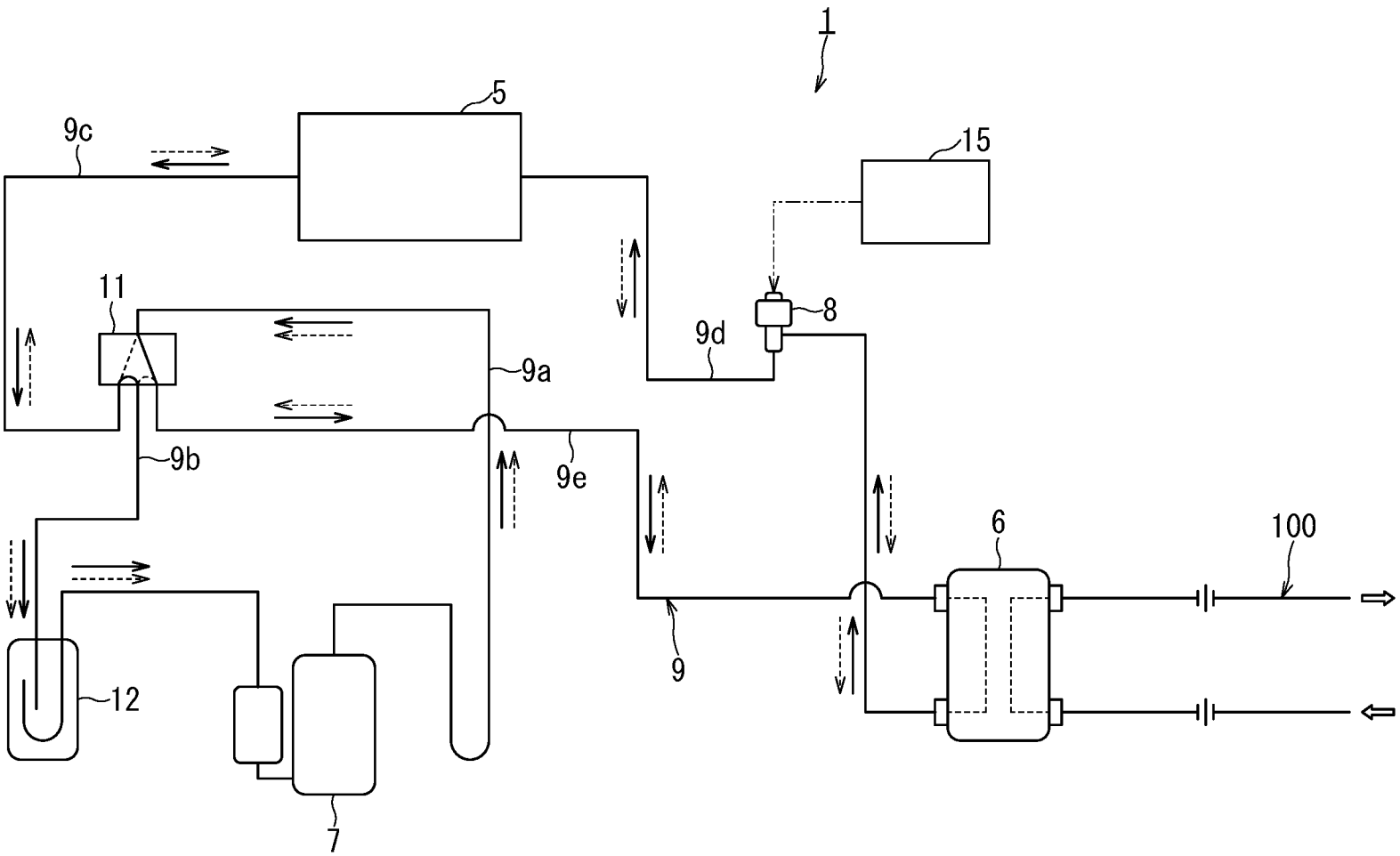
FIG. 1 is a block diagram of a refrigeration cycle apparatus according to one embodiment of the present invention.

FIG. 1 is a block diagram of a refrigeration cycle apparatus according to one embodiment of the present invention.

As shown in FIG. 1, the refrigeration cycle apparatus 1 according to the present embodiment is a heat source apparatus, for example, a so-called chiller. The refrigeration cycle apparatus 1 includes: a first heat exchanger 5 as an air heat exchanger configured to exchange heat between air and a refrigerant circulating in the refrigeration cycle apparatus 1; and a second heat exchanger 6 as a water heat exchanger configured to exchange heat between the refrigerant circulating in the refrigeration cycle apparatus 1 and water or brine circulating in a utilization side 100. The refrigeration cycle apparatus 1 may be an air conditioner that performs air-conditioning in a living room as the utilization side 100. Additionally, the refrigeration cycle apparatus 1 may be a heat pump that supplies or circulates high-temperature water to the utilization side 100.

The refrigeration cycle apparatus 1 includes a compressor 7, the first heat exchanger 5, an electronic expansion valve 8, the second heat exchanger 6, and refrigerant piping 9. The refrigerant piping 9 connects the first heat exchanger 5, the second heat exchanger 6, the compressor 7, and the electronic expansion valve 8, and circulates the refrigerant.

The refrigeration cycle apparatus 1 further includes a four-way valve 11 and an accumulator 12 that is provided in the refrigerant piping 9 between the four-way valve 11 and the compressor 7. The four-way valve 11 sends the refrigerant discharged from the compressor 7 to one of the first heat exchanger 5 and the second heat exchanger 6, and causes the refrigerant having passed through the other of the first heat exchanger 5 and the second heat exchanger 6 to be sucked back into the compressor 7.

In the case of a chiller, the compressor 7, the first heat exchanger 5, the electronic expansion valve 8, the second heat exchanger 6, the refrigerant piping 9, the four-way valve 11, and the accumulator 12 are housed in the same housing 13. In particular, the compressor 7, the electronic expansion valve 8, the second heat exchanger 6, the refrigerant piping 9, the four-way valve 11, and the accumulator 12 are densely housed in a machine chamber partitioned at the lower portion of the housing 13.

Each of the first heat exchanger 5 and second heat exchanger 6 is, for example, fin-and-tube type. The first heat exchanger 5 functions as a condenser when the refrigeration cycle apparatus 1 performs cooling operation, and functions as an evaporator when the refrigeration cycle apparatus 1 performs heating operation. The second heat exchanger 6 functions as an evaporator when the refrigeration cycle apparatus 1 performs cooling operation, and functions as a condenser when the refrigeration cycle apparatus 1 performs heating operation. The refrigeration cycle apparatus 1 during the cooling operation cools down fluid such as water and brine flowing through the utilization side 100 by using the second heat exchanger 6. The refrigeration cycle apparatus 1 during the heating operation heats up the fluid such as water and brine flowing through the utilization side 100 by using the second heat exchanger 6. The fluid flowing through the utilization side 100 may be various liquids such as a cleaning liquid and oil aside from the fluid such as water and brine or may be other fluid.

The compressor 7 compresses the refrigerant, raises the pressure of the refrigerant, and discharges the refrigerant. The compressor 7 may be either capable of changing its operation frequency by, for example, known inverter control, or not capable of changing its operation frequency.

The electronic expansion valve 8 is, for example, a PMV (Pulse Motor Valve). The electronic expansion valve 8 is a valve with adjustable opening degree. The electronic expansion valve 8 includes a valve body having a through hole, a needle configured to be able to move forward and backward with respect to the through hole, and a power source configured to generate power for moving the needle forward and backward, for example. When the through hole is plugged with the needle, the electronic expansion valve 8 stops (blocks) the flow of refrigerant in the refrigerant piping 9. At this time, the electronic expansion valve 8 is closed, i.e., the opening degree of the electronic expansion valve 8 is the smallest. Conversely, when the needle is farthest from the through hole, the electronic expansion valve 8 maximizes the flow rate of the refrigerant. At this time, the electronic expansion valve 8 is fully opened, i.e., the opening degree of the electronic expansion valve 8 is the largest.

The power source is, for example, a stepping motor. When the number of pulses to be inputted to the stepping motor is zero, the electronic expansion valve 8 is closed. When the number of pulses to be inputted to the stepping motor is the maximum, the electronic expansion valve 8 is fully opened. The maximum number of pulses is, for example, several hundred pulses. In the present embodiment, the maximum number of pulses is assumed to be 500 pulses. The opening degree of the electronic expansion valve 8 is correlated to or proportional to this number of pulses.

The refrigerant piping 9 sequentially connects the compressor 7, the four-way valve 11, the first heat exchanger 5, the electronic expansion valve 8, and the second heat exchanger 6. The refrigerant piping 9 includes a first refrigerant pipe 9*a* connecting the discharge side of the compressor 7 and the four-way valve 11, a second refrigerant pipe 9*b* connecting the suction side of the compressor 7 and the four-way valve 11, a third refrigerant pipe 9*c* connecting the four-way valve 11 and the first heat exchanger 5, a fourth refrigerant pipe 9*d* connecting the first heat exchanger 5 and the second heat exchanger 6, and a fifth refrigerant pipe 9*e* connecting the second heat exchanger 6 and the four-way valve 11. The electronic expansion valve 8 and a silencer 15 are provided in the middle of the fourth refrigerant pipe 9*d*.

The four-way valve 11 switches the direction of the refrigerant flowing through the refrigerant piping 9. When the refrigeration cycle apparatus 1 performs heating operation so as to raise the water temperature on the utilization side 100 (i.e., the refrigerant flow indicated by the solid arrow in FIG. 1), the four-way valve 11 circulates the refrigerant from the first refrigerant pipe 9*a* to the fifth refrigerant pipe 9*e* and circulates the refrigerant from the third refrigerant pipe 9*c* to the second refrigerant pipe 9*b*. When the refrigeration cycle apparatus 1 performs cooling operation so as to lower the water temperature on the utilization side 100 (i.e., the refrigerant flow indicated by the dashed arrow in FIG. 1), the four-way valve 11 circulates the refrigerant from the first refrigerant pipe 9*a* to the third refrigerant pipe 9*c* and circulates the refrigerant from the fifth refrigerant pipe 9*e* to the second refrigerant pipe 9*b*.

The refrigeration cycle apparatus 1 also includes a controller (not shown) that is electrically connected to the electronic expansion valve 8 and the four-way valve 11 via signal lines (not shown). The controller may be connected to the compressor 7 that can change the operation frequency.

The controller includes a central processing unit (not shown) and a storage device (not shown) that stores various computation programs to be executed by the central processing unit, parameters, and the like. The controller loads various control programs from its auxiliary storage device to its main storage device, and executes the various control programs loaded into the main storage device by using the central processing unit.

The controller switches the state of the four-way valve 11 on the basis of a request from the utilization side 100 so as to switch the refrigeration cycle apparatus 1 between the cooling operation and the heating operation.

During the cooling operation (i.e., the flow of the refrigerant indicated by the dashed arrow in FIG. 1), the refrigeration cycle apparatus 1 discharges the compressed high-temperature and high-pressure refrigerant from the compressor 7, and sends this refrigerant to the first heat exchanger 5 via the four-way valve 11. The first heat exchanger 5 exchanges heat between the air and the refrigerant passing through the tube, thereby cools down the refrigerant, and brings it into a high-pressure liquid state. In other words, during the cooling operation, the first heat exchanger 5 functions as a condenser. The refrigerant having passed through the first heat exchanger 5 passes through the electronic expansion valve 8 so as to be depressurized and become a low-pressure gas-liquid two-phase refrigerant, and then reaches the second heat exchanger 6. The second heat exchanger 6 exchanges heat between the water on the utilization side 100 and the refrigerant passing through the tube, thereby cools down the water. At this time, the second heat exchanger 6 functions as an evaporator that evaporates the refrigerant into a gaseous state. The refrigerant having passed through the second heat exchanger 6 is sucked into the compressor 7 and returned.

Conversely, during the heating operation (i.e., the flow of the refrigerant indicated by the solid arrow in FIG. 1), the refrigeration cycle apparatus 1 reverses the four-way valve 11 so as to generate a refrigerant flow in the refrigeration cycle in the direction opposite to the refrigerant flow during the cooling operation, thereby causes the second heat exchanger 6 to function as a condenser, and causes the first heat exchanger 5 to function as an evaporator.

Note that the refrigeration cycle apparatus 1 may be dedicated to the cooling operation without the four-way valve 11. In this case, the discharge side of the compressor 7 is connected to the first heat exchanger 5 through the refrigerant piping 9, and the suction side of the compressor 7 is connected to the second heat exchanger 6 through the refrigerant piping 9.

Figure 2:
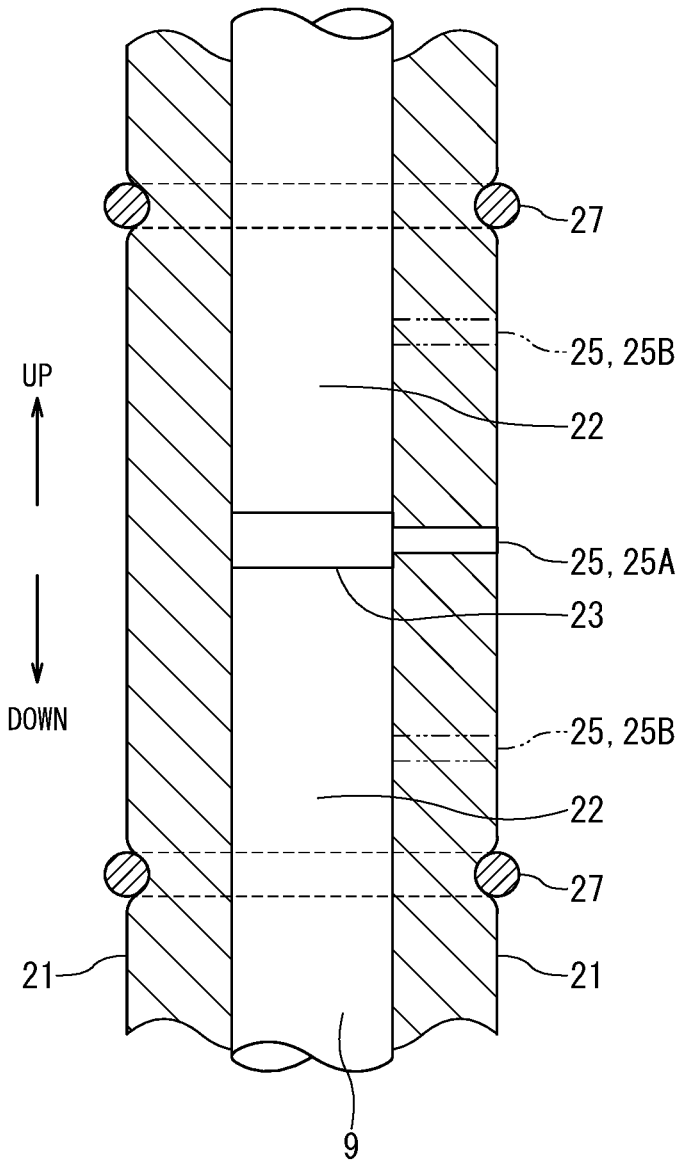
FIG. 2 is a schematic cross-sectional view of refrigerant piping and a piping cover of the refrigeration cycle apparatus according to the embodiment of the present invention.
Figure 3:
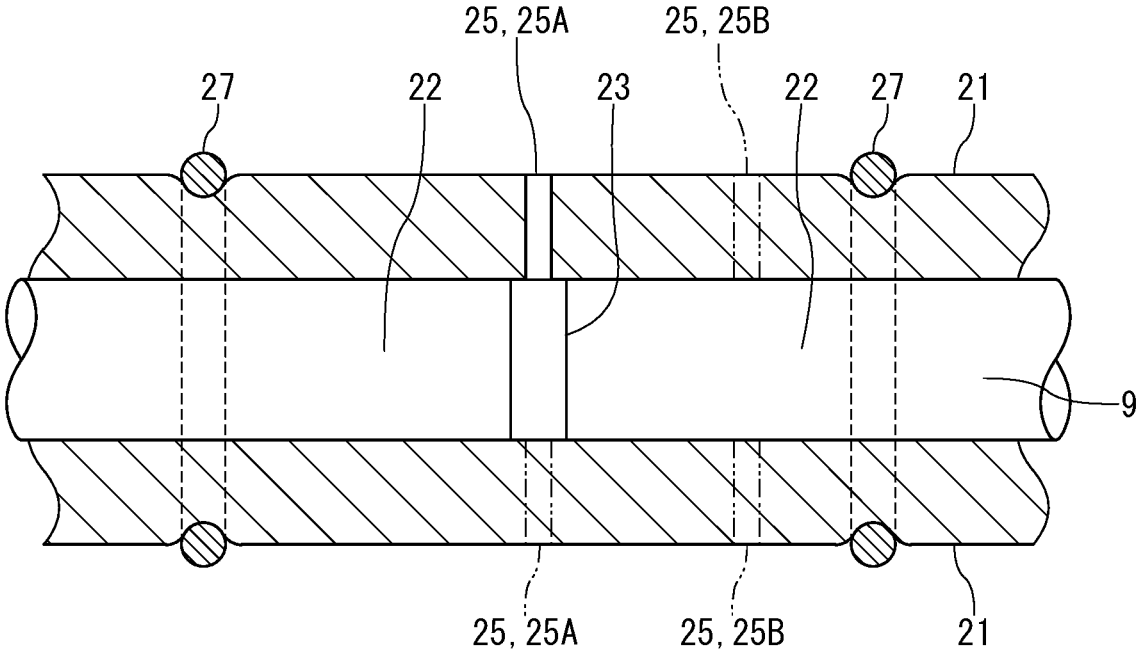
FIG. 3 is another schematic cross-sectional view of the refrigerant piping and the piping cover of the refrigeration cycle apparatus according to the embodiment of the present invention.
Figure 4:
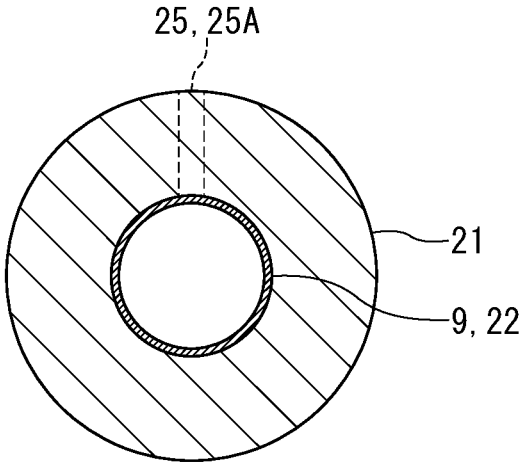
FIG. 4 is still another schematic cross-sectional view of the refrigerant piping and the piping cover of the refrigeration cycle apparatus according to the embodiment of the present invention.

FIG. 2 to FIG. 4 are schematic cross-sectional views of the refrigerant piping and a piping cover of the refrigeration cycle apparatus according to the embodiment of the present invention.

FIG. 2 is a cross-sectional view in the extending direction (longitudinal direction) for illustrating the so-called rising pipe (i.e., the portion where the refrigerant piping 9 extends in the vertical direction).

FIG. 3 is a cross-sectional view in the extending direction of the refrigerant piping 9 for illustrating the portion where the refrigerant piping 9 extends in the horizontal direction.

FIG. 4 is a cross-sectional view in the direction orthogonal to the extending direction of the refrigerant piping 9.

As shown in FIG. 2 to FIG. 4, the refrigeration cycle apparatus 1 according to the present embodiment includes the refrigerant piping 9 for circulating the refrigerant and a piping cover 21 that covers at least part of the refrigerant piping 9.

The refrigerant piping 9 includes a plurality of metal pipe materials 22 and joints that join adjacent pipe materials 22. The material of the pipe materials 22 is selected from metals such as copper, aluminum, aluminum alloy, and stainless steel. The joints are, for example, mechanical joints such as flare joints, brazed joints by brazing, and welded joints by welding. In other words, the refrigerant piping 9 has joints 23 that join the pipe materials 22 by brazing or welding. The joints 23 are brazed joints or welded joints. For example, a copper pipe material 22 is joined by brazing with the use of a phosphor bronze brazing filler and/or a silver braze filler as the brazing filler metal.

The piping cover 21 obscures at least part of the refrigerant piping 9 including at least one joint 23. The piping cover 21 functions as a heat insulation material or a heat retention material that inhibits heat exchange between the refrigerant piping 9 and the atmosphere surrounding the refrigerant piping 9. The piping cover 21 may have closed cells that inhibit the flow of the gas from the inside of the piping cover 21 to the outside. This type of piping cover 21 is, for example, an elastomer tube (pipe or cylinder) having a closed-cell structure. In addition, the piping cover 21 may have a double structure in which an open-celled heat insulation material covering the refrigerant piping 9 is further covered with a highly airtight outer cover such as a sheet and sheet metal, and obstructs the flow of the gas from the inside of the piping cover 21 to its outside. This type of piping cover 21 may be an open-celled elastomer tube (pipe or cylinder) covered with a sheet metal, for example, or may have a structure in which a poromeric heat insulation material such as glass wool is covered with a sheet metal.

Hereinafter, for facilitating understanding, it is assumed that the refrigerant piping 9 is filled with a gas at a pressure higher than the atmospheric pressure. Further, it is assumed that the joint 23 has a so-called leak path such as a minute crack and a minute hole.

When the pressure inside the refrigerant piping 9 is higher than the atmospheric pressure, the gas inside the refrigerant piping 9 leaks out from the refrigerant piping 9 through the leak path of the joint 23. In the case of the closed-cell piping cover 21, the gas having leaked out from the refrigerant piping 9 fills the small gap between the refrigerant piping 9 and the piping cover 21. In the case of the double-structure piping cover 21 with the airtight outer cover, the gas having leaked out from the refrigerant piping 9 fills the space inside the piping cover 21, i.e., the space between open cells and fibers.

For this reason, the piping cover 21 has a leakage inspection port 25 that allows the gas to flow out from the inside of the piping cover 21 to the outside of the piping cover 21. The leakage inspection port 25 may be disposed near the radially outer side of the joint 23 so as to be directly connected to the joint 23, like a leakage inspection port 25A. Additionally, the leakage inspection port 25 may be disposed at a position away from the joint 23 in the longitudinal direction of the refrigerant piping 9, like a leakage inspection port 25B.

The leakage inspection port 25 is, for example, a hole or pore with a diameter of about 2 mm. In the case of the closed-cell piping cover 21, the leakage inspection port 25 is a hole that reaches a small gap between the refrigerant piping 9 and the piping cover 21. In the case of the double-structure piping cover 21 with the airtight outer cover, the leakage inspection port 25 is a hole through the airtight outer cover.

Next, a description will be given of the leakage inspection method for the refrigerant piping 9.

Figure 5:
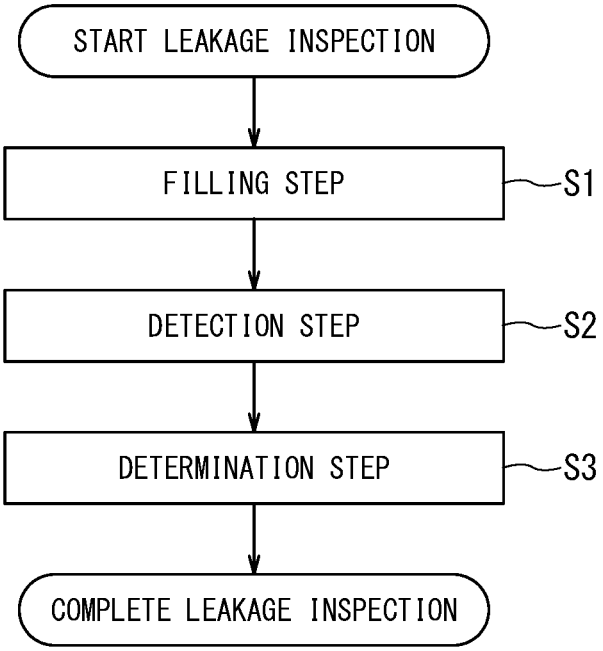
FIG. 5 is a chart illustrating a leakage inspection method for the refrigerant piping of the refrigeration cycle apparatus according to another embodiment of the present invention.

FIG. 5 is a chart illustrating the leakage inspection method for the refrigerant piping of the refrigeration cycle apparatus according to the embodiment of the present invention.

As shown in FIG. 5, the leakage inspection method for the refrigerant piping 9 according to the present embodiment includes: a filling step S1 of filling the refrigeration cycle apparatus 1 with a gas excluding air as a leak detection gas until the pressure becomes higher than the atmospheric pressure; a detection step S2 of detecting the concentration of oxygen at the leakage inspection port 25 or the concentration of the leakage detection gas at the leakage inspection port 25; and a determination step S3 of determining whether leakage occurs at the joint 23 of the refrigerant piping 9 based on the detection result of the detection step S2.

The leakage detection gas is, for example, a refrigerant to be used in a refrigeration cycle apparatus, such as R32 (hydro fluorocarbon, HFC) and a helium gas, which is smaller in molecular weight than the refrigerant. In the case of performing the leakage inspection by using the helium gas that is sufficiently smaller in molecular weight than the refrigerant circulating in the refrigeration cycle apparatus 1, the leakage inspection for the refrigerant piping 9 can be performed under extremely severe conditions. In a situation where the refrigeration cycle apparatus 1 is being installed or in operation, the leakage inspection can be readily and quickly performed by using the refrigerant that fills the refrigerant piping 9. Even though the refrigerant to be charged into the refrigeration cycle apparatus 1 during steady operation of the refrigeration cycle apparatus 1 is not meant for inspecting leakage from the refrigerant piping 9, leakage of the refrigerant piping 9 can still be detected during steady operation by detecting the concentration of the leaked refrigerant or the concentration of the air contained in the atmosphere that is diluted by the leaked refrigerant.

When the specific gravity of the leakage detection gas is higher than that of the air, the leakage inspection port 25 is desirably disposed below the joint 23. When the leakage detection gas with a higher specific gravity than the air leaks out from the refrigerant piping 9, the leakage detection gas having leaked out from the refrigerant piping 9 moves toward the side lower than the joint 23 and reaches the leakage inspection port 25. Conversely, when the specific gravity of the leakage detection gas is lower than that of the air, the leakage inspection port 25 is desirably disposed above the joint 23. When the leakage detection gas with a lower specific gravity than the air leaks out from the refrigerant piping 9, the leakage detection gas having leaked out from the refrigerant piping 9 moves toward the side higher than the joint 23 and reaches the leakage inspection port 25.

As to the filling pressure of the leakage detection gas, it is sufficient if the filling pressure of the leakage detection gas is slightly higher than the atmospheric pressure. For example, it is satisfactory if the filling pressure is higher than the atmospheric pressure by 0.02 kilopascals (KPa) or more. In the filling step S1, before inspection for the slight leakage from the joint 23 of the refrigerant piping 9 in the detection step S2, presence/absence of a relatively large leakage point caused by, for example, an assembly work error may be inspected. Such an inspection is performed by temporarily filling the refrigeration cycle apparatus 1 with the leakage detection gas at a pressure higher than the maximum discharge pressure of the compressor 7 and then measuring and observing change in pressure for a predetermined period of time by using a pressure gauge having standard measurement accuracy. If a large leakage point exists, the filling pressure of the leakage detection gas will gradually decrease.

In the detection step S2, the concentration of the leakage detection gas at the leakage inspection port 25 may be directly detected by using a detector that can detect the leakage detection gas itself. In the case of using a helium gas as the leakage detection gas, a helium detector is used as the detector.

Additionally, in the detection step S2, the concentration of oxygen at the leakage inspection port 25 may be detected by using a detector, which can detect the concentration of oxygen contained in the atmosphere with the use of the leakage detection gas, so that leakage of the leakage detection gas is indirectly detected by detecting decrease in oxygen concentration. In either case, occurrence or non-occurrence of leakage of the leakage detection gas from the refrigerant piping 9 can be determined by determining whether the concentration of the detected gas is high or low or by determining whether change in gas concentration is recognized.

If the leakage detection gas is leaking from the refrigerant piping 9, the leakage detection gas leaks to the inside of the piping cover 21 as described above. The piping cover 21 substantially causes the leakage detection gas having leaked from the refrigerant piping 9 to flow from the leakage inspection port 25 to the outside of the piping cover 21. In other words, in the leakage inspection method for the refrigerant piping 9 according to the present embodiment, presence/absence of a leak path in the joint 23 can be determined by directly or indirectly detecting the leakage detection gas flowing out of the leakage inspection port 25 to the outside of the piping cover 21.

In other words, when the joint 23 of the refrigerant piping 9 is at a location that is easy to approach and highly accessible and can secure sufficient space for leakage inspection work, the leakage inspection for the joint 23 can be readily performed by using the leakage inspection port 25 located close to the joint 23.

Conversely, when the joint 23 of the refrigerant piping 9 is located in a narrow space that is hard to approach and inaccessible and cannot secure sufficient space for the leakage inspection work, the leakage inspection for the joint 23 can be readily performed by disposing the leakage inspection port 25 at a location that is away from the joint 23, easy to approach, and highly accessible, and has a sufficient space for the leakage inspection work.

In addition, the refrigeration cycle apparatus 1 may include a pair of constrictors 27 that sandwich at least one joint 23 of the refrigerant piping 9 and at least one leakage inspection port 25 of the piping cover 21 therebetween and narrow the gap between the piping cover 21 and the refrigerant piping 9. In the rising portion of the refrigerant piping 9 as shown in FIG. 2, the constrictors 27 are disposed above the joint 23 and the leakage inspection port 25 and below the joint 23 and the leakage inspection port 25. In the horizontal portion of the refrigerant piping 9 as shown in FIG. 3, the constrictors 27 are disposed on the upstream side of the joint 23 and the leakage inspection port 25 and on the downstream side of the joint 23 and the leakage inspection port 25.

In the case of the closed-cell piping cover 21, the pair of constrictors 27 is binding devices that are wrapped around the outer periphery of the piping cover 21 to close the slight gap between the piping cover 21 and the refrigerant piping 9, as exemplified by binding bands including strings, ropes, and tie wraps. In the case of the double-structure piping cover 21 having the airtight outer cover, the sheet metal cover as the outer cover may be partially narrowed or a flange-shaped structure adjacent to the refrigerant piping 9 may be provided in the sheet metal cover. Additionally, the binding devices may be wrapped around an open-celled heat insulation material, and the heat insulation material and the binding devices may be integrally covered with an airtight sheet.

The pair of constrictors 27 prevents the gas having leaked out from the leak path of the joint 23 from spreading over a wide range within the piping cover 21, limits the range where the gas accumulates, and thereby maintains a state in which the concentration of the gas having leaked out from the leak path of the joint 23 can be more easily detected.

Between the pair of constrictors 27, it is sufficient if at least one joint 23 and at least one leakage inspection port 25 are included. In the case of prioritizing individual check of leakage at each of the joints 23, the pair of constrictors 27 is disposed in such a manner that the pair of constrictors 27 sandwiches one joint 23 and one leakage inspection port 25 corresponding to each other one-to-one. In the case of prioritizing easy inspection of occurrence/non-occurrence of leakage in an appropriate section of the refrigerant piping 9, the pair of constrictors 27 is disposed in such a manner that the constrictors 27 sandwich a plurality of joints 23 and one leakage inspection port 25 included in the section and correspond to each other on a many-to-one basis.

Figure 6:
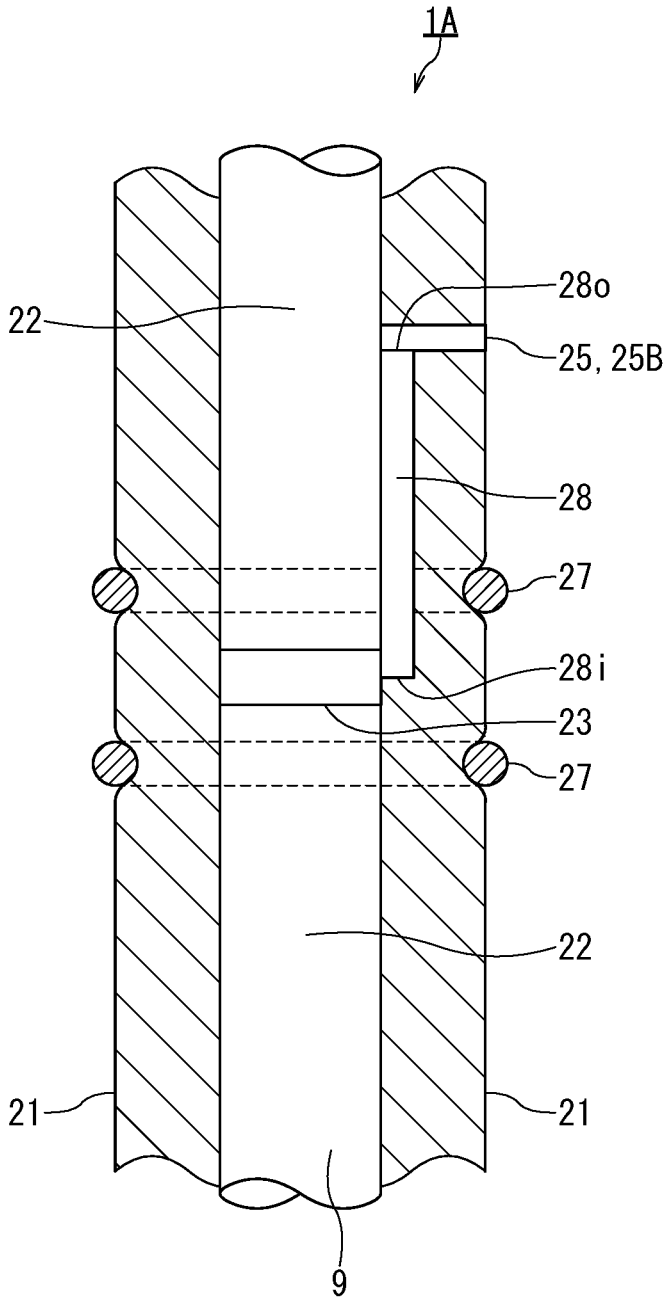
FIG. 6 is a schematic cross-sectional view of another aspect of the refrigerant piping and the piping cover of the refrigeration cycle apparatus according to the embodiment of the present invention.
Figure 7:
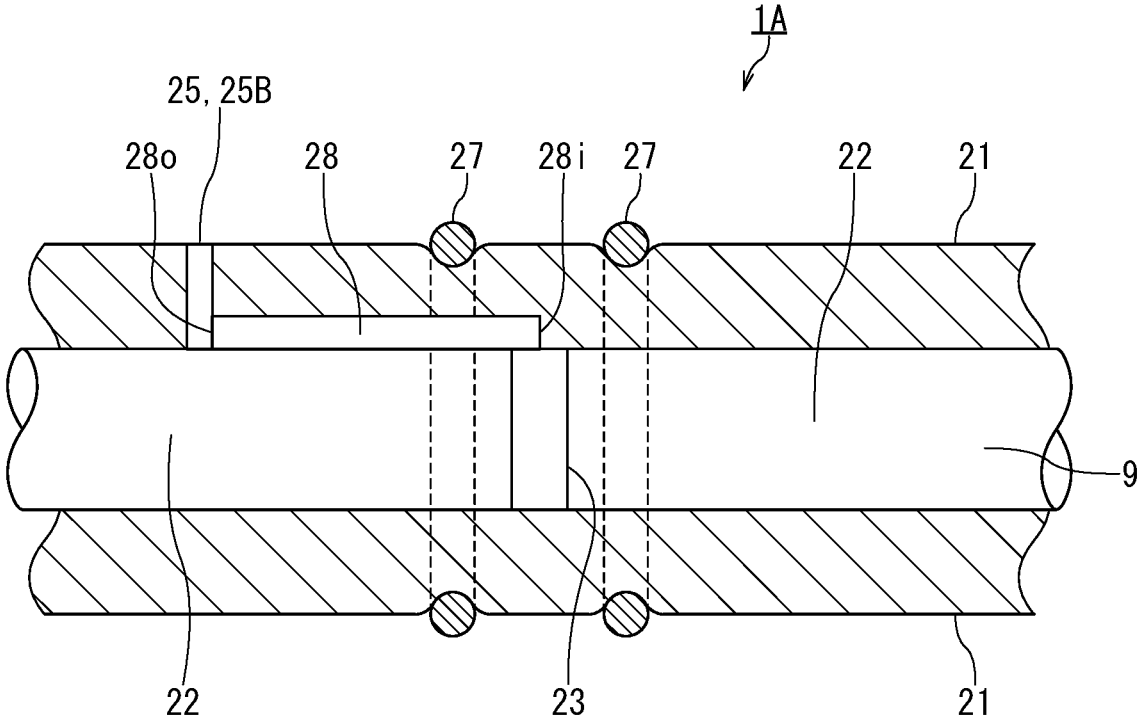
FIG. 7 is another schematic cross-sectional view of the other aspect of the refrigerant piping and the piping cover of the refrigeration cycle apparatus according to the embodiment of the present invention.
Figure 8:
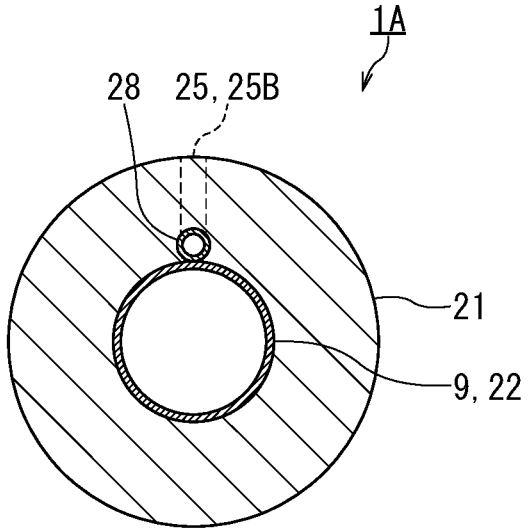
FIG. 8 is still another schematic cross-sectional view of the other aspect of the refrigerant piping and the piping cover of the refrigeration cycle apparatus according to the embodiment of the present invention.

FIG. 6 to FIG. 8 are schematic cross-sectional views of another aspect of the refrigerant piping and the piping cover of the refrigeration cycle apparatus according to the embodiment of the present invention.

FIG. 6 is a schematic cross-sectional view in the extending direction (longitudinal direction) for illustrating the so-called rising pipe (i.e., the portion where the refrigerant piping 9 extends in the vertical direction).

FIG. 7 is a cross-sectional view in the extending direction of the refrigerant piping 9 for illustrating the portion where the refrigerant piping 9 extends in the horizontal direction.

FIG. 8 is a cross-sectional view in the direction orthogonal to the extending direction of the refrigerant piping 9.

As shown in FIG. 6 to FIG. 8, the refrigeration cycle apparatus 1A according to the present embodiment includes a leakage inspection pipe 28 that is covered with the piping cover 21 together with the refrigerant piping 9 and has an inlet opening 28*i* disposed near the joint 23 of the refrigerant piping 9 and an outlet opening 280 connected to the leakage inspection port 25.

Both FIG. 6 and FIG. 7 illustrate the case where the specific gravity of the leakage detection gas is lower than the specific gravity of the air. When the specific gravity of the leakage detection gas is higher than the specific gravity of the air, the leakage inspection pipe 28 is disposed in such a manner that the leakage inspection port 25 is disposed below the joint 23.

The leakage inspection pipe 28 partitions a flow path that leads the gas leaking from the leak path of the joint 23 to the leakage inspection port 25. As to the leakage inspection pipe 28, it is sufficient if the leakage inspection pipe 28 extends along the refrigerant piping 9.

In the case of the refrigeration cycle apparatus 1 that does not have the leakage inspection pipe 28, the gas having leaked into the piping cover 21 does not necessarily flow toward the leakage inspection port 25 and does not diffuse toward the leakage inspection port 25. The leakage inspection pipe 28 of the refrigeration cycle apparatus 1A reliably leads the gas having leaked into the piping cover 21 to the leakage inspection port 25.

In addition, the leakage inspection pipe 28 is not installed separately from the refrigerant piping 9 and/or the piping cover 21 like the suction pipe in the conventional detection apparatus but is buried in the piping cover 21.

Thus, when the joint 23 of the refrigerant piping 9 is positioned in a narrow and inaccessible space that is difficult to approach and insufficient for performing the leakage inspection work, the leakage inspection of the joint 23 can be readily performed by disposing the leakage inspection port 25 at a highly accessible location that is away from the joint 23, easy-to-approach, and has sufficient space for the leakage inspection work. Moreover, the refrigeration cycle apparatus 1A does not require an additional space or volume for installing the leakage inspection pipe 28.

In addition, by properly disposing the leakage inspection port 25, the refrigeration cycle apparatus 1A can quickly and readily lead a slightly flammable refrigerant such as R32 leaking from the joint 23 to a safe location and dilute it.

As described above, each of the refrigeration cycle apparatuses 1 and 1A according to the present embodiment includes the piping cover 21 that has the leakage inspection port 25 configured to allow the gas leaking from the joint 23 of the refrigerant piping 9 to flow from the inside of the piping cover 21 to the outside of the piping cover 21. Thus, the refrigeration cycle apparatus 1 and the leakage inspection method for its refrigerant piping 9 can have the leakage inspection port 25 disposed at an appropriate location without being limited to the location of the joint 23 of the refrigerant piping 9. Hence, for example, even in a chiller in which the joint 23 of the refrigerant piping 9 is at an inaccessible location that is hard-to-access and poor in terms of workability, occurrence/non-occurrence of leakage in the joint 23 can be readily inspected according to the refrigeration cycle apparatuses 1 and 1A and the leakage inspection method for their refrigerant piping 9.

In addition, the refrigeration cycle apparatuses 1 and 1A and the leakage inspection method for their refrigerant piping 9 can individually inspect normality of each of the joints 23 by having one-to-one correspondence between the joints 23 of the refrigerant piping 9 and the leakage inspection ports 25 of the piping cover 21. For example, when one joint 23 and one leakage inspection port 25 are disposed between a pair of constrictors 27, normality of the joint 23 provided in this section can be readily inspected separately.

Further, when a slightly flammable refrigerant such as R32 leaks from the joint 23, the refrigeration cycle apparatuses 1 and 1A and the leakage inspection method for their refrigerant piping 9 can limit the leak location, where the refrigerant is leaked to the atmosphere, to the leakage inspection port 25. In other words, appropriate disposition of the leakage inspection port 25 allows a slightly flammable refrigerant such as R32 leaking from the joint 23 to be readily led to a safe location and be diluted.

Moreover, each of the refrigeration cycle apparatuses 1 and 1A according to the present embodiment includes the leakage inspection port 25 that is disposed below the joint 23 in the case of the leakage inspection gas having a higher specific gravity than the air, and is disposed above the joint 23 in the case of the gas having a lower specific gravity than the air. Hence, the refrigeration cycle apparatuses 1 and 1A and the leakage inspection method for their refrigerant piping 9 can readily inspect occurrence/non-occurrence of leakage in the joint 23 without using any means to suck in the gas having leaked out from the joint 23.

Furthermore, each of the refrigeration cycle apparatuses 1 and 1A according to the present embodiment includes a pair of constrictors 27 that sandwich the joint 23 of the refrigerant piping 9 and the leakage inspection port 25 of the piping cover 21 therebetween and narrow the gap between the piping cover 21 and the refrigerant piping 9. Hence, the refrigeration cycle apparatuses 1 and 1A and the leakage inspection method for their refrigerant piping 9 can appropriately set the number of the joints 23 and the leakage inspection ports 25 to be sandwiched between the pair of constrictors 27 and can flexibly set the inspection mode depending on needs. In addition, the refrigeration cycle apparatuses 1 and 1A and the leakage inspection method for their refrigerant piping 9 can prevent unnecessary diffusion of the leakage detection gas by limiting the inspection target section using the pair of constrictors 27, and thus, can increase the reliability of the inspection.

Further, the refrigeration cycle apparatus 1A according to the present embodiment includes the leakage inspection pipe 28 that is covered with the piping cover 21 together with the refrigerant piping 9 and has the inlet opening 28*i* disposed near the joint 23 and the outlet opening 280 connected to the leakage inspection port 25. Hence, the refrigeration cycle apparatus 1A and the leakage inspection method for its refrigerant piping 9 does not require an additional space or volume for installing the leakage inspection pipe 28, and can inspect occurrence/non-occurrence of leakage in the joint 23 disposed at an inaccessible and narrow location, which is hard-to-approach and insufficient for the leakage inspection work, by using the leakage inspection port 25 disposed at an easy-to-approach and highly accessible location with sufficient space for the leakage inspection work.

Moreover, the refrigeration cycle apparatus 1A can quickly and readily lead a slightly flammable refrigerant such as R32 leaking from the joint 23 to a safe location and dilute it.

Thus, according to the refrigeration cycle apparatuses 1 and 1A and the leakage inspection method for their refrigerant piping 9 of the present embodiment, leakage inspection of the joint 23 of the refrigerant piping 9 can be easily performed regardless of the location of the joint 23 including a hard-to-approach, inaccessible, and extremely narrow space.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

REFERENCE SIGNS LIST

1, 1A refrigeration cycle apparatus
5 first heat exchanger
6 second heat exchanger
7 compressor
8 electronic expansion valve
9 refrigerant piping
9*a* first refrigerant pipe
9*b* second refrigerant pipe
9*c* third refrigerant pipe
9*d* fourth refrigerant pipe
9*e* fifth refrigerant pipe
11 four-way valve
12 accumulator
13 housing
15 silencer
21 piping cover
22 pipe material
23 joint
25, 25A, 25B leakage inspection port
27 constrictor
28 leakage inspection pipe
28*i* inlet opening
280 outlet opening
100 utilisation side

The invention claimed is:

1. A refrigeration cycle apparatus comprising:

a compressor;

a condenser;

an expansion valve;

an evaporator;

refrigerant piping that connects the compressor, the condenser, the expansion valve, and the evaporator and that is configured to circulate a refrigerant;

a piping cover that covers at least part of the refrigerant piping; and a housing containing the compressor, the condenser, the expansion valve, the evaporator, the refrigerant piping, and the piping cover, wherein:

the refrigerant piping includes a plurality of pipe materials and at least one joint that joins the pipe materials by brazing or welding;

the piping cover covers the at least one joint and includes at least one leakage inspection port configured to allow a gas to flow from inside of the piping cover to outside of the piping cover; and the refrigeration cycle apparatus further comprises a pair of constrictors configured to sandwich the at least one joint and the at least one leakage inspection port and narrow a gap between the piping cover and the refrigerant piping.

2. The refrigeration cycle apparatus according to claim 1, wherein the at least one leakage inspection port is disposed below the at least one joint when the gas is higher in specific gravity than air, and is disposed above the at least one joint when the gas is lower in specific gravity than the air.

3. The refrigeration cycle apparatus according to claim 1, further comprising a leakage inspection pipe that is covered with the piping cover together with the refrigerant piping and includes an inlet opening disposed near the at least one joint and an outlet opening connected to the at least one leakage inspection port.

4. The refrigeration cycle apparatus according to claim 2, further comprising a leakage inspection pipe that is covered with the piping cover together with the refrigerant piping and includes an inlet opening disposed near the at least one joint and an outlet opening connected to the at least one leakage inspection port.

5. A leakage inspection method for refrigerant piping of a refrigeration cycle apparatus that includes: a compressor; a condenser; an expansion valve; an evaporator; a piping cover provided with at least one a leakage inspection port configured to allow a gas to flow from inside of the piping cover to outside of the piping cover; refrigerant piping that is at least partially covered with the piping cover, connects the compressor, the condenser, the expansion valve, and the evaporator, is configured to circulate a refrigerant, and includes at least one joint joined by brazing or welding; a housing containing the compressor, the condenser, the expansion valve, the evaporator, the refrigerant piping, and the piping cover; and a pair of constrictors configured to sandwich the at least one joint and the at least one leakage inspection port and narrow a gap between the piping cover and the refrigerant piping, the leakage inspection method comprising:

filling the refrigeration cycle apparatus with a leak detection gas excluding air as the gas until pressure becomes higher than atmospheric pressure;

detecting concentration of oxygen at the leakage inspection port or concentration of the leakage detection gas at the leakage inspection port; and determining whether leakage occurs at the joint based on a detection result of the detecting.

* * * * *